US009918531B2

(12) United States Patent
Barmes

(10) Patent No.: US 9,918,531 B2
(45) Date of Patent: Mar. 20, 2018

(54) TRAVEL CASE LUGGAGE WITH COMPARTMENTS

(71) Applicant: Paul Anthony Barmes, Orewa (NZ)

(72) Inventor: Paul Anthony Barmes, Orewa (NZ)

( * ) Notice: Subject to any disclaimer, the term of this patent is extended or adjusted under 35 U.S.C. 154(b) by 87 days.

(21) Appl. No.: 14/654,718

(22) PCT Filed: Dec. 20, 2013

(86) PCT No.: PCT/IB2013/061165

§ 371 (c)(1),
(2) Date: Jun. 22, 2015

(87) PCT Pub. No.: WO2014/097225

PCT Pub. Date: Jun. 26, 2014

(65) Prior Publication Data

US 2015/0342317 A1 Dec. 3, 2015

(30) Foreign Application Priority Data

Dec. 21, 2012 (NZ) ..... 605211

(51) Int. Cl.

| | |
|---|---|
| ***A44C 5/06*** | (2006.01) |
| ***A45C 5/03*** | (2006.01) |
| ***E05F 1/12*** | (2006.01) |
| ***A45C 5/02*** | (2006.01) |
| ***A45C 5/06*** | (2006.01) |
| ***A45C 5/14*** | (2006.01) |

(52) U.S. Cl.

CPC ..... *A45C 5/03* (2013.01); *A45C 5/02* (2013.01); *A45C 5/06* (2013.01); *A45C 5/14* (2013.01); *E05F 1/12* (2013.01); *A45C 2005/037* (2013.01)

(58) Field of Classification Search

CPC ..... A45C 5/146; A45C 2012/267; A45C 2013/267; A45C 5/06; A45C 2005/037

USPC ..... 150/117, 122; 190/109, 111, 112, 122

See application file for complete search history.

(56) References Cited

U.S. PATENT DOCUMENTS

| | | | | | |
|---|---|---|---|---|---|
| 258,814 | A | | 5/1882 | Scott | |
| 745,133 | A | * | 11/1903 | Axelman | A45C 13/02 190/109 |
| 775,343 | A | * | 11/1904 | Anderson | A45C 3/00 190/111 |
| 1,502,987 | A | * | 7/1924 | Glass | A45C 5/00 190/111 |

(Continued)

FOREIGN PATENT DOCUMENTS

| | | | |
|---|---|---|---|
| CN | 101342845 | A | 1/2009 |
| DE | 228770 | A1 | 10/1985 |
| EP | 0753383 | A1 | 1/1997 |

*Primary Examiner* — Sue A Weaver

(74) *Attorney, Agent, or Firm* — Heisler & Associates

(57) ABSTRACT

A hard travel case is described comprising a main body with a main compartment, two sub-compartments, each hinging on a first side of the main body between a closed position and open position, whereby in the closed position together the sub-compartments close the main compartment, and in the open position access is provided to the main compartment, wherein each sub-compartment comprises an access door hinging on a first side of the sub-compartment between a closed position whereby the access door closes the sub-compartment and an open position allowing access to the sub-compartment.

20 Claims, 9 Drawing Sheets

(56) References Cited

U.S. PATENT DOCUMENTS

| | | | | | |
|---|---|---|---|---|---|
| 2,172,695 | A * | 9/1939 | Brody | A45C 3/06 | 150/115 |
| 2,213,821 | A * | 9/1940 | McCurdy | A45C 5/00 | 190/111 |
| 4,303,158 | A | 12/1981 | Perkins | | |
| 5,366,071 | A | 11/1994 | Laszlo | | |
| 5,474,162 | A * | 12/1995 | Shyr | A45C 13/262 | 190/109 |
| 6,076,641 | A * | 6/2000 | Kinzer | A45C 5/14 | 16/18 CG |
| 6,102,172 | A * | 8/2000 | Dercole | A45C 5/005 | 190/109 |
| 8,453,813 | B2 * | 6/2013 | Lai | A45C 5/14 | 190/109 |
| 2004/0154889 | A1 * | 8/2004 | Gifford | A45C 5/14 | 190/18 A |
| 2008/0056625 | A1 * | 3/2008 | Stanton | B65F 1/0006 | 383/104 |
| 2011/0186396 | A1 * | 8/2011 | Sheikh | A45C 13/10 | 190/111 |
| 2014/0027224 | A1 * | 1/2014 | Lai | A45C 5/14 | 190/111 |

* cited by examiner 17A
14
21A
24A
15
49
1
24A
22A
24B
22B
29
13B
13A
17B

19

24A
22A
24B
11

15
14
16B
13B
11
21E
49
22A
24A
29
22B
24B 17A
21A
49
24A
29
16B
22A
13B
22B
24B 1
16B
13B
16
14
49
21E
22A
22B
24A
24B

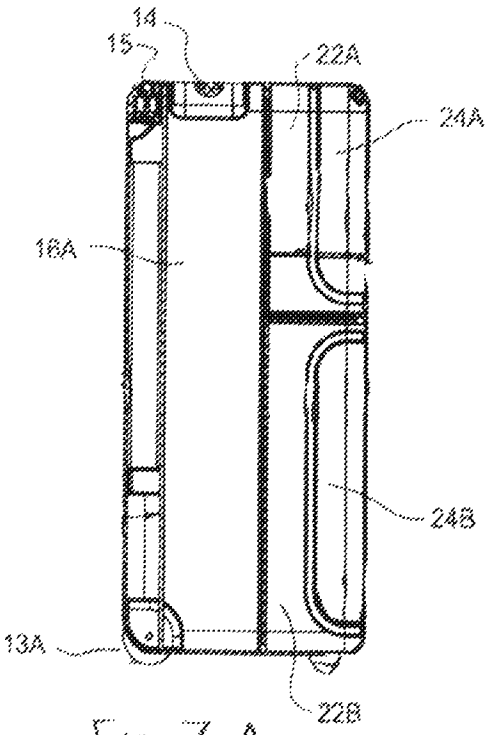
Fig. 7-A
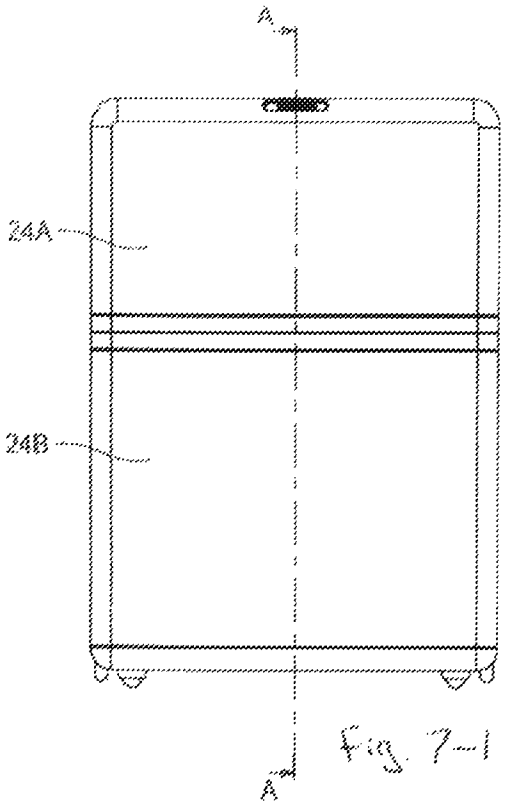
Fig. 7-I

Fig. 8-B

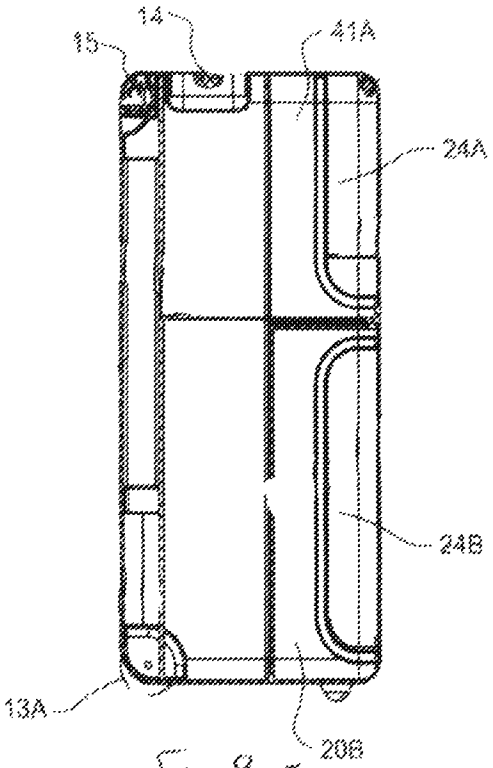
Fig. 9-C
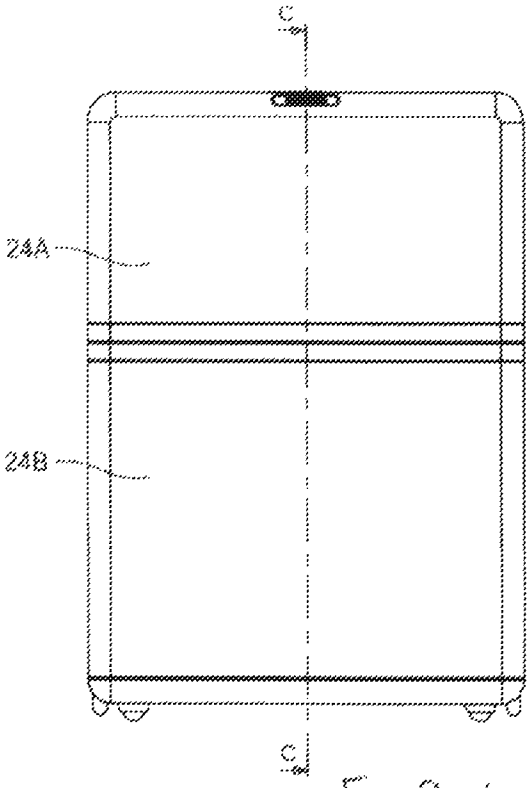
Fig. 9-I

TRAVEL CASE LUGGAGE WITH COMPARTMENTS

FIELD OF THE INVENTION

The present invention relates to a case for travel.

SUMMARY OF INVENTION

The object of the present invention is to provide a travel case with multiple compartments.

In one aspect the present invention may be said to consist in a hard travel case comprising: a main body with a main compartment, two sub-compartments, each hinging on a first side of the main body between a closed position and open position, whereby in the closed position together the sub-compartments close the main compartment, and in the open position access is provided to the main compartment, wherein each sub-compartment comprises an access door hinging on a first side of the sub-compartment between a closed position whereby the access door closes the sub-compartment and an open position allowing access to the sub-compartment.

Preferably the main compartment has an opening and each sub-compartment hinges independently between the closed position and the open position, wherein in the closed position each sub-compartment partially blocks the opening such that together the sub-compartments when in the closed position close the main compartment by blocking the opening.

Alternatively the main compartment has an opening and each sub-compartment hinges in unison between the closed position and the open position to close the main compartment by blocking the opening.

Preferably the sub-compartment comprises a sub-body and an access door that when closed forms the sub-compartment.

Optionally, each access door may have sides to create an interior.

Preferably each access door hinges on a bottom edge of the sub-body such that the access door swings outwards on a horizontal axis.

Preferably each sub-compartment hinges on a side edge of the main body such that the sub-compartment swings outwards on a vertical axis.

Optionally, each compartment, sub-compartment and/or access door can have dividers.

Preferably the main body and/or the bottom sub-compartment comprises wheels.

Preferably the main body comprises one or more handles.

Preferably the hard travel case is for use in the portrait position, and in that position the sub-compartments hinge on a vertical axis on the first side of the main body and each access door hinges on a horizontal axis on the first side of the sub-compartment.

Preferably the hard travel case is made from one or more of:

polypropylene
polycarbonate
ABS
Nylon
Acrylic
Polyester.

Preferably the hinging takes place by one or more spring hinges.

In another aspect the present invention may be said to consist in a hard travel case comprising a main body with at least two main compartments, a main compartment access door allowing access to a first main compartment of the main body, a first sub-compartment hinging on a first side of the main body between a closed position whereby the sub-compartment closes a second main compartment, and an open position allowing access to the second main compartment, wherein the sub-compartment comprises a sub-compartment access door hinging on a first side of the sub-compartment between a closed position whereby the sub-compartment access door closes the sub-compartment and an open position allowing access to the sub-compartment.

Preferably when the hard travel case is in the portrait position, the first sub-compartment is above the main compartment access door.

Preferably when the hard travel case is in the portrait position, the first sub-compartment is below the main compartment access door.

Preferably the sub-compartment comprises a sub-body and an access door that when closed forms the sub-compartment.

Optionally, each access door may have sides to create an interior.

Preferably each access door hinges on a bottom edge of the sub-body such that the access door swings outwards on a horizontal axis.

Preferably each sub-compartment hinges on a side edge of the main body such that the sub-compartment swings outwards on a vertical axis.

Optionally, each compartment, sub-compartment and/or access door can have dividers.

Preferably the main body and/or the bottom sub-compartment comprises wheels.

Preferably the main body comprises one or more handles.

Preferably the hard travel case is for use in the portrait position, and in that position the sub-compartment hinges on a vertical axis on the first side of the main body and each access doors hinge on a horizontal axis on the first side of the sub-compartment or main compartment.

Preferably the hard travel case is made from one or more of:

polypropylene
polycarbonate
ABS
Nylon
Acrylic
Polyester.

Preferably the hinging takes place by one or more spring hinges.

In another aspect the present invention may be said to consist in a hard travel case comprising a main body with one or more main compartments, one or more sub-compartments hinging on a first side of the main body, each sub-compartment hinging on a first side of the main body between a closed position and an open position, whereby in the closed position the sub-compartment partially or fully blocks some or all of the one or more main compartments, and in the open position allows access to one or more of the main compartments, wherein each sub-compartment comprises an access door hinging on a first side of the sub-compartment between a closed position whereby the access door closes the sub-compartment and an open position allowing access to the sub-compartment.

Preferably one or more of the main compartments has a main access door allowing access to that main compartment.

Preferably the hard travel case for use in the portrait position, and in that position each sub-compartment hinges on a vertical axis on the first side of the main body and each access door hinges on a horizontal axis on the first side of the sub-compartment.

Preferably the hard travel case for use in the portrait position, and in that position each door hinges horizontally with respect to the main body.

Preferably the hard travel case is made from one or more of:

polypropylene
polycarbonate
ABS
Nylon
Acrylic
Polyester.

Preferably the hinging takes place by one or more spring hinges.

Preferably, any embodiment can be constructed from the following components: a main body, two frames and two access doors.

In another aspect the present invention may be said to consist in a hard travel case comprising a main body with a main compartment, a frame hinging vertically on a side of the main body (when in the portrait position) between a closed position and open position, whereby in the closed position the frame closes the main compartment, and in the open position access is provided to the main compartment, the frame comprising two sub-bodies each forming a sub-compartment, each sub-body having an access door hinging horizontally on the sub-body, the access door hinging between a closed position whereby the access door closes the sub-compartment and an open position allowing access to the sub-compartment.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

The term "comprising" as used in this specification means "consisting at least in part of". When interpreting each statement in this specification that includes the term "comprising", features other than that or those prefaced by the term may also be present. Related terms such as "comprise" and "comprises" are to be interpreted in the same manner.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

BRIEF DESCRIPTION OF DRAWINGS

Preferred embodiments of the invention will now be described with reference to the drawings, of which:

FIGS. 1A, 1B and 1C show the travel case luggage of this invention according to three embodiments. FIG. 1A shows a first embodiment with both a top lid and a bottom lid pivotably fixed to a common frame/body which opens relative to an opposing side of a main body of the case; FIG. 1A-1 showing this first embodiment lying flat and FIG. 1A-2 showing this first embodiment upright in a portrait orientation. FIG. 1B shows a second embodiment with a top lid opening relative to an opposing side of a main body of the case, and with a bottom lid pivotably fixed to the main body of the case; FIG. 1B-1 showing this second embodiment lying flat and FIG. 1B-2 showing this second embodiment upright in a portrait orientation. FIG. 1C shows a third embodiment with a top lid pivotably fixed to the main body of the case, and with a bottom lid opening relative to an opposing side of a main body of the case; FIG. 1C-1 showing this second embodiment lying flat and FIG. 1C-2 showing this second embodiment upright in a portrait orientation.

FIG. 2A shows a series of views of the first embodiment of the case with lids of compartments and the opening frame/body in different orientations; FIG. 2A-1 showing a perspective view of the case lying flat with all compartment open; FIG. 2A-2 showing a perspective view of the case in a portrait orientation with all compartments open; FIG. 2A-3 showing a side elevation view of the case in a portrait orientation with a main compartment closed and lids of sub-compartments open; FIG. 2A-4 showing a side elevation view of the case in a portrait orientation with all compartments closed.

FIG. 2B shows a series of views similar to those of FIG. 2A, but for the second embodiment.

FIG. 3 shows a spring hinge used in the embodiment described.

FIG. 4 shows a series of orthogonal views of the case of this invention according to any one of the above embodiments.

FIG. 5 shows a series of orthogonal views of a modified embodiment of the case of this invention similar to FIG. 4, but with unique wheels and rear surface and latch details.

FIG. 6 shows a series of perspective views of the case of this invention, similar to the modified embodiment of FIG. 5.

FIG. 7 shows a front elevation view and a section view of the first embodiment of the case of this invention.

FIG. 9 shows a front elevation view and a section view of the third embodiment of the case of this invention.

DETAILED DESCRIPTION OF PREFERRED EMBODIMENTS

Figures 1, 1A, 1B, 1C, 2:
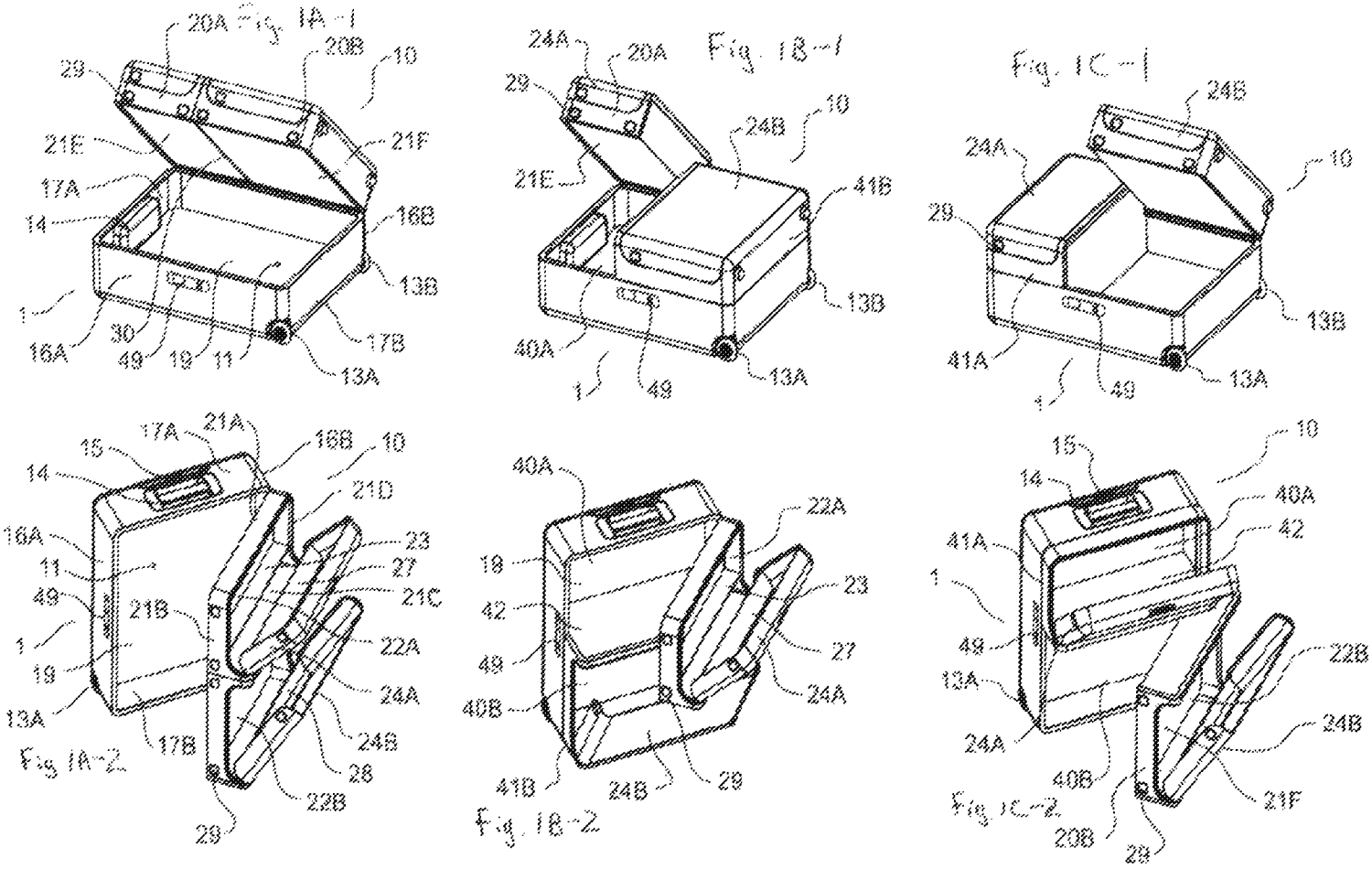

FIG. 1A shows a first embodiment of the travel case 10 in two open configurations and two orientations (lie flat and portrait). The travel case is a hard case and is manufactured from one or more suitable hard material(s), preferably plastics, such as:

polypropylene
polycarbonate
ABS
Nylon
Acrylic
Polyester.

The travel case 10 comprises a main body 1 forming a main/primary compartment 11 for clothing, business tools or material, other personal items, or anything else typically placed in luggage. The main body 1 is of any suitable shape, most suitably rectangular comprising a back panel 19, two sides 16A, 16B and a top/bottom 17A, 17B. The main body 1 has an open side (opening) that allows access to the interior 11. The main body 1 can optionally comprise shelves or other dividers in the main compartment 11 to assist with storage and organisation of items. The main body comprises wheels 13A, 13B rotatably attached to the bottom edge of the main body 1 (when viewed in the portrait position). The main body comprises one or more handles positioned at suitable locations. FIG. 1A shows two handles 14, 15—the first handle 14 being for carrying the travel case and the second handle 15 being an extendable handle for pulling the case on the wheels. Handles can be placed in other positions also optionally, such as on the side 16A, 16B of the main body.

The travel case also comprises two sub-bodies 20A, 20B (which could be termed "frames"). With reference numerals referring to the top sub-body by way of example, each sub-body comprises a frame/body comprising sides 21B, 21D, top/bottom 21A, 21C and a backing portion 21E to create a sub-compartment 22A, 22B for clothing, business tools material, other personal items or anything else typically placed in luggage. Each sub-body 20A, 20B can optionally comprise shelves or other dividers in the sub compartment to assist with storage and organisation of items, e.g. 23. Each sub-body has an access door 24A, 24B attached to it to close off the sub-body 20A, 20B thus forming the respective sub-compartment 22A, 22B. The access door might be a panel, or itself also comprise sides and a top (as shown in FIG. 1A). Where the access door itself comprises sides 21A-21D, it can also form an interior portion or compartment 27. The access door 24A, 24B can optionally comprise shelves or other dividers e.g. 28 in the compartment to assist with storage and organisation of items. The access door (either with or without sides) together with the sub-body forms the sub-compartment 22A, 22B when in the closed position. Each access door 24A, 24B is attached to the respective sub-body 20A, 20B with a hinge (which could be one or more hinges—see FIGS. 2A and 3) along the horizontal bottom edge (when the travel case is in the portrait position). This allows the access door 24A, 24B to swing about the horizontal hinge axis (when the travel cases in the portrait position) between a closed position and an open position—where the sub-compartment 22A, 22B is accessible (along with the interior compartment 27 of the access door if there is one). The hinge can comprise one or more hinge components which may operate together or independently. The hinge is shown in FIG. 3.

Figures 1, 2, 2A, 2B, 3, 4:
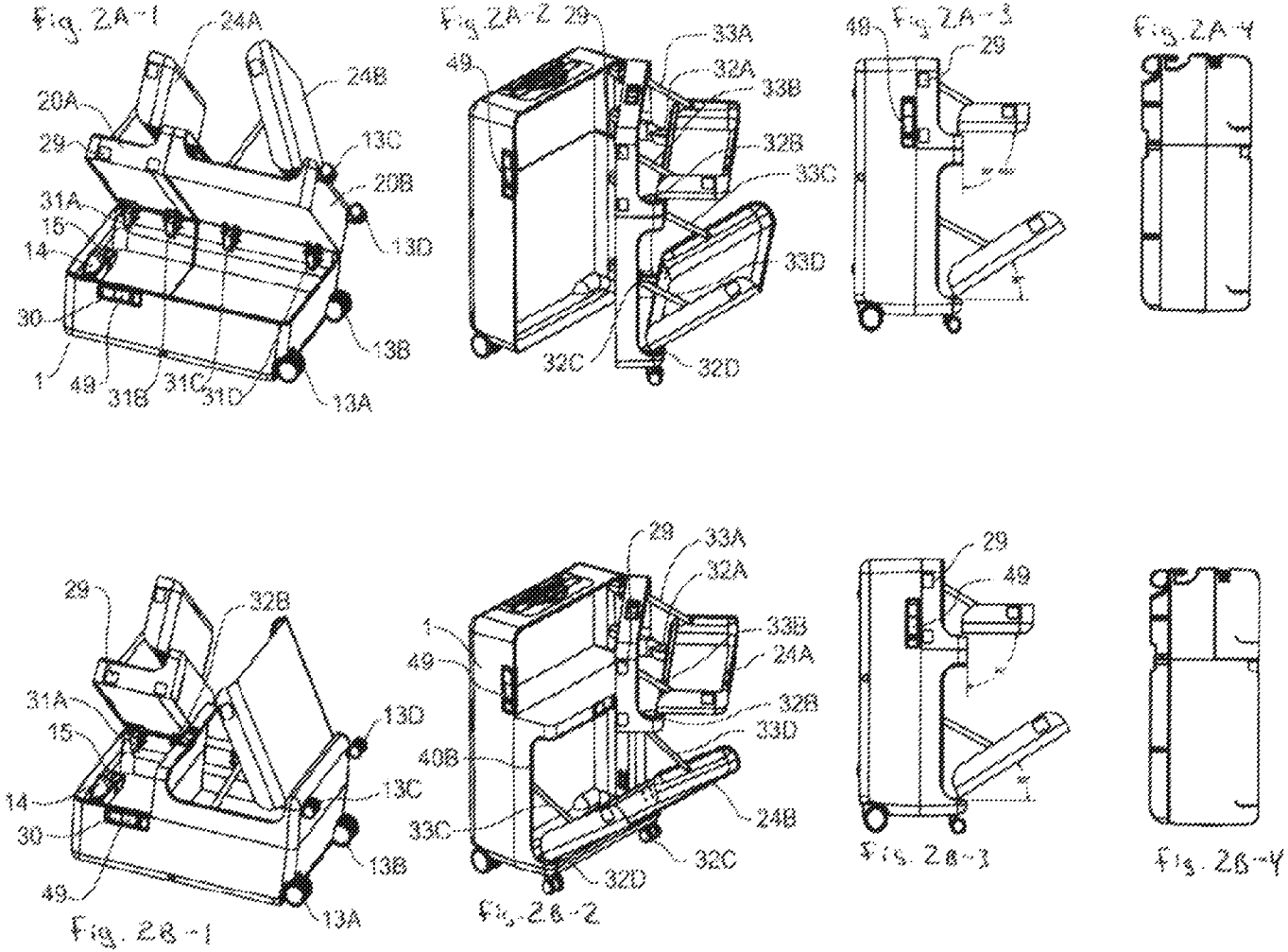
Figure 3:
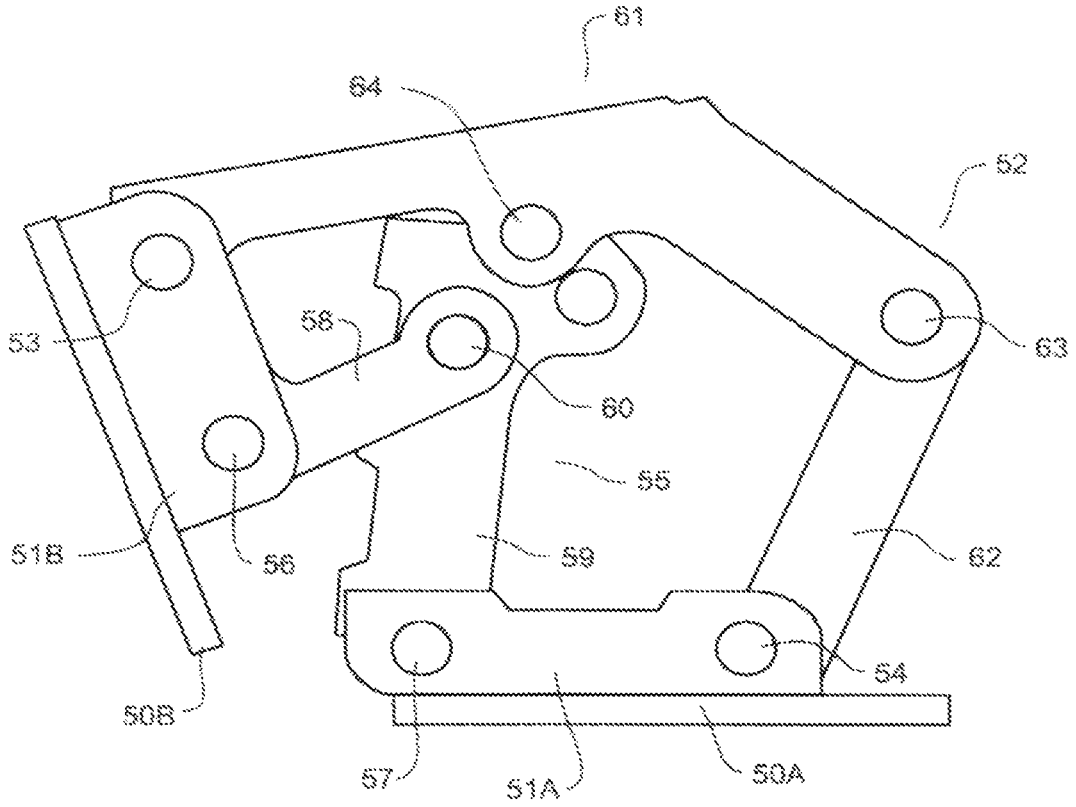
Figures 1, 2, 3, 4, 5, 6:
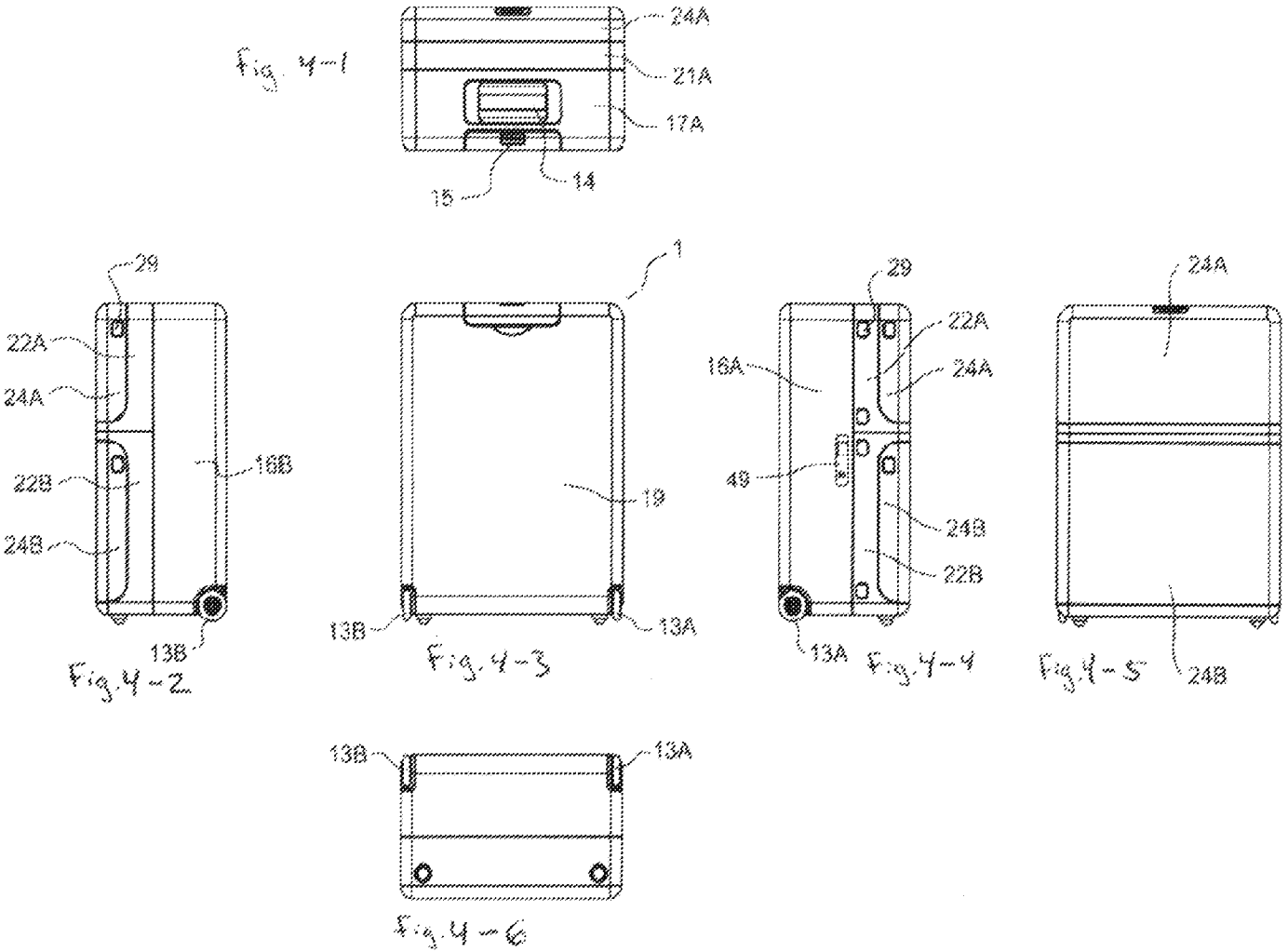
Figures 1, 2, 3, 4, 5, 6:
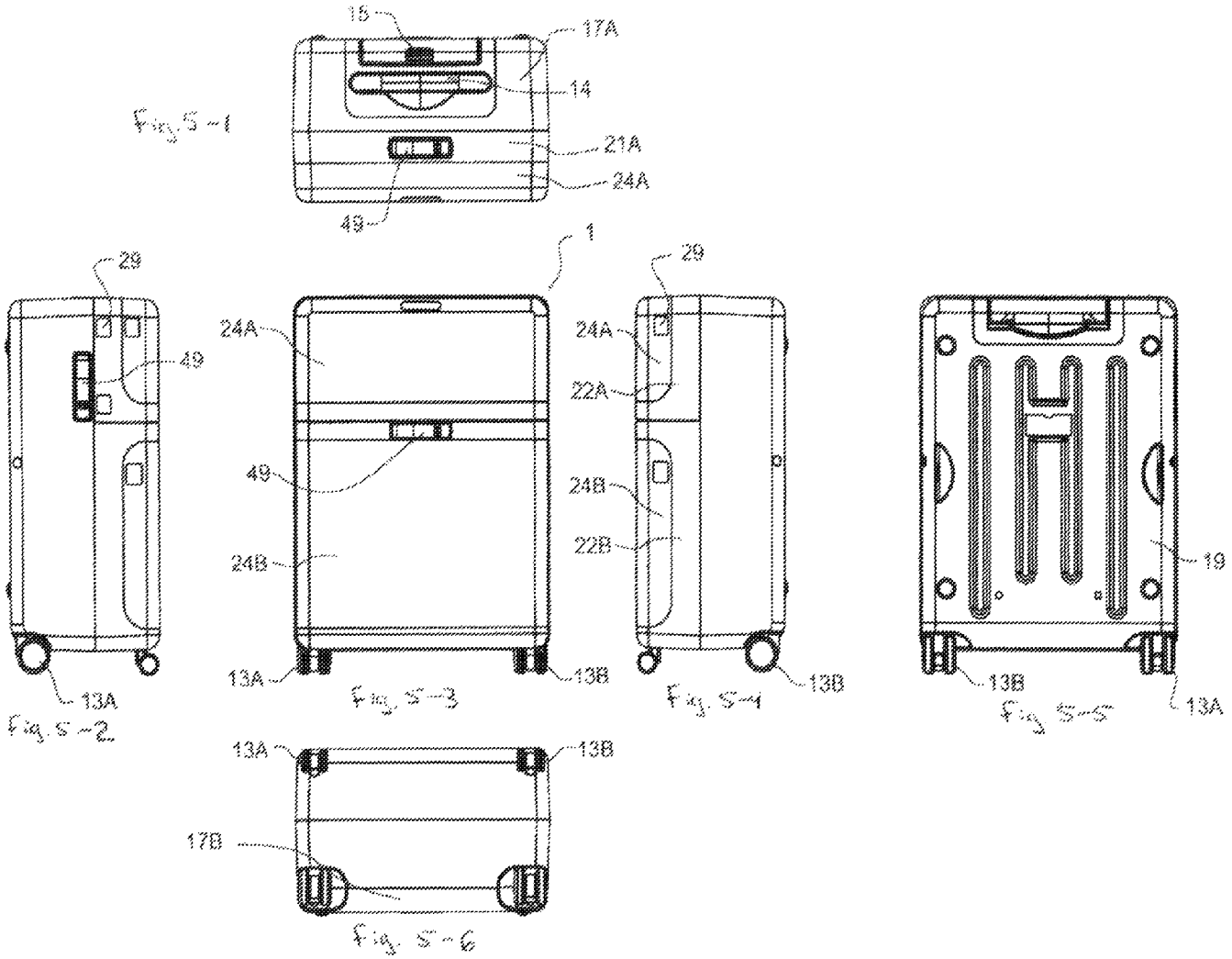
Figures 1, 2, 3, 4, 6:
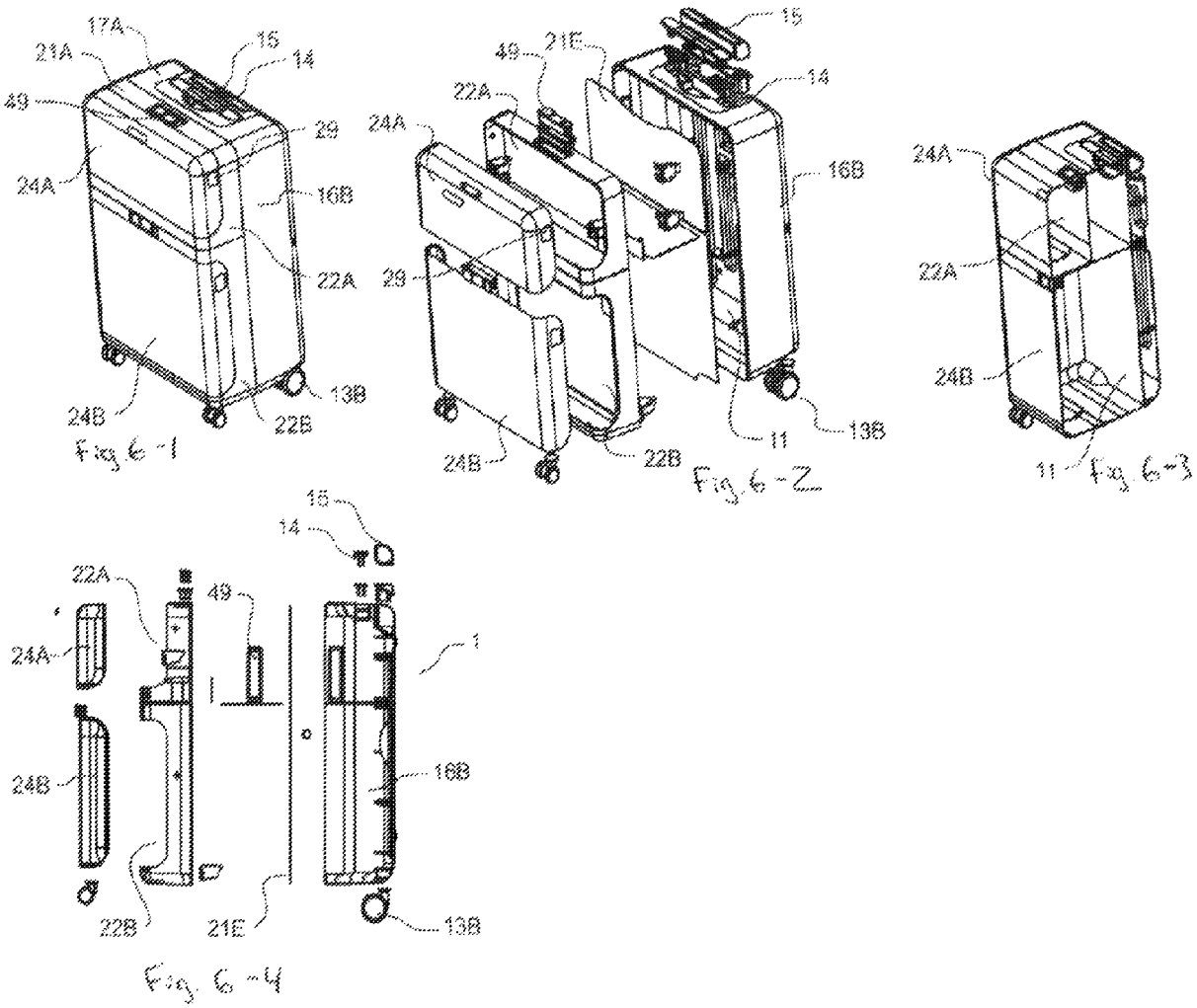
Figure 8:
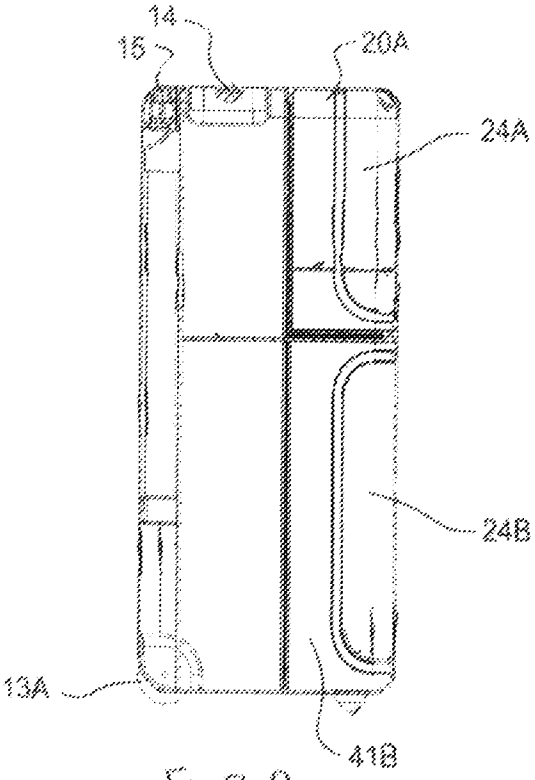
FIG. 8 shows a front elevation view and a section view of the second embodiment of the case of this invention.
Figure 1:
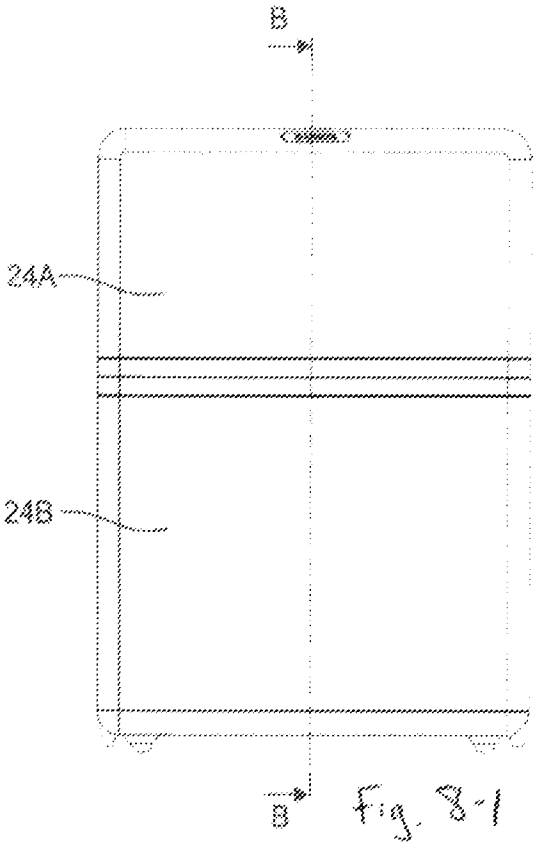

The two sub-bodies 20A, 20B are attached to the main body with a hinge (which could be one or more hinges such as shown in FIG. 3) along the vertical edge (when the travel cases in the portrait position) of the main body 1 and the two sub-bodies 20A, 20B. This allows the sub-bodies to swing about the vertical hinge between a closed position in which the sub-bodies/sub-compartments 20A, 20B close off the main compartment by blocking the opening and an open position where the opening is not blocked and the main compartment 11 is accessible through the opening. In one variation, the two sub-bodies 20A, 20B are fixed along their abutting/adjoining top and bottom sides 30 such that they swing between the open and close position in unison, either by being formed as two separate bodies joined together, or alternatively by being manufactured as a single integrated body. In an alternative variation, the two sub-bodies 20A, 20B are not fixed along the abutting top and bottom sides 30 and they can swing independently. In this case, when each sub-compartment/body in the closed position it only partially blocks the opening of the main compartment 11, and it requires the other sub-compartment 20A, 20B to be in the closed position also to fully close off the main compartment 11. An aluminium rim can be placed around the perimeter of the aperture to the main compartment 11 to assist with securing and/or aligning the main body 1 with the frame/sub-body 20A, 20B when they close off the main compartment 11. The travel case further comprises one or more locks (such as combination locks) e.g. 49 known to persons skilled in the art for securing the frame/sub-body 20A, 20B against the main compartment 11, and/or for securing the access door(s) 24A against individual sub-compartment(s). One or more frame or bodies, for example 1, 20A, 20B further comprises sets of releasable catches (e.g. 29) to secure the frame/sub-body 20A, 20B in relation to the main compartment 11, and/or secure the access door(s) 24A, 24B in relation to the sub-compartment(s) to retain them in the closed position. The catches could be magnetic catches or any other suitable mechanical catches.

The travel case can be utilised in any suitable manner for any suitable purpose. For example, large and/or less frequently needed items can be placed in the main compartment 11 and accessed from main compartment by swinging one or both of the sub-bodies/compartments 20A, 20B from the closed position to the open position. When doing so, typically the access door of each sub-body is in the closed position, but this is not essential. Smaller and more frequently required items can be placed in both the sub-compartments 22A, 22B. These can be accessed by swinging the relevant access door 24A, 24B from the closed position to the open position to access the interior of the sub-compartment 22A, 22B. This may be done either when that respective sub-body 20A or 20B is in the closed position with respect to the main body, or when it is in the open position. The main compartment 11 can be accessed when the travel case is in any orientation, such as when flat on a surface or when in the portrait position. Preferably, it will normally be accessed when in the lie flat position. Likewise, each sub-compartment can be accessed when the travel case is in any orientation. Preferably, they will normally be accessed when the travel case is in the portrait position but this is not essential. It will be appreciated that when referring to the open position, this does not mean that the sub-bodies 20A, 20B and/or the access doors 24A, 24B have to be open to the full extent. "Open" can just mean that the door and/or sub compartments are swung open to a sufficient degree in order to access the respective compartment/sub-compartment. The configuration of the travel case allows convenient organisation and access to different items for different purposes in a different manner, each manner being suitable depending on the item and situation, and the orientation of the travel case.

FIG. 2A shows a variation of the embodiment in FIG. 1A in more detail. FIG. 2A shows the travel case in various orientations and configurations, including the lie flat orientation, portrait orientation, and with the main compartment and sub-compartments open, the sub-compartments only open, and all compartments closed. The main body 1 comprises a handle 30 on the side as well is a top handle 14 and extendable handle 15. It also comprises wheels 13A, 13B (such as castors or similar) on a bottom edge. The sub-bodies 20A, 20B are attached to the main body 1 by a plurality of spring hinges 31A-31D, that is, two spring hinges for each sub-body. The spring hinge is shown in more detail FIG. 3. Any suitable number of spring hinges could be used. In the case where each sub-body hinges independently, two hinges could be used for each sub-body, such as shown in FIG. 2A for example. In the case where the two sub-bodies hinge in unison, a lesser number of hinges could be used and arranged in a suitable manner. Wheels (such as castors) 13C, 13D are attached to the front bottom edge of the bottom sub-compartment 20B. Each access door 24A, 24B also hinges on two spring hinges 32*a*-32D, such as shown in FIG.

3. Two stays 33A-33D extend from the side of the respective sub-body 20A, 20B to the side of the respective access door 24A, 24B in each case to limit the extent of swing on the hinge. The stays 33A-33D can be any suitable mechanism, such as two-piece bi-fold stays or stays that slide within channels on respective attachment portions. In the case of the top sub-body 20A, the access door can swing to 90° relative to the main body 1 in the portrait position, being held in place (open position) by, and further movement being restricted by, the stays 33A, 33B. This allows the interior or top surface of the access door 24A to be used as a tray and/or provides easy access to the contents of the access door 24A and the top sub-compartment 22A. In the case of the bottom sub-body 20B, the access door can swing to 60° relative to the main body 1 in the portrait position, also being held in place by, and further movement being restricted by, the stays 33C, 33D. This allows access to the interior of the bottom sub-compartment 22B. The bottom access door does not extend as far to reduce the risk of the travel case toppling over when in the portrait position through weight of items on the access door 24B. It will be appreciated that both the top and bottom access doors 24A, 24B can swing to any suitable open position angle and those angels described are not the only option.

FIG. 1B shows a second embodiment of the travel case. The travel case is a hard case and is manufactured from one or more suitable hard material(s), preferably plastics, as mentioned above. Any aspects not fully described will be the same or similar to that described for the first embodiment.

The travel case 10 comprises a main body 1 with at least two separate main/primary (top and bottom when in portrait position) compartments 40A, 40B for clothing, business tools or material, other personal items, or anything else typically placed in luggage. The main body 1 is of any suitable shape typically rectangular and can have a similar shape and exterior configuration as described for embodiment 1. A dividing portion (formed in any suitable manner by any suitable structure) is provided 42 to create the two compartments. The main body 1 comprises wheels 13A, 13B rotatably attached to the bottom of the main body (when viewed in the portrait position). The main body 1 comprises one or more handles 14, 15 positioned at suitable locations. FIG. 1B shows to handles 14, 15—the first handle being for carrying the travel case and the second handle being an extendable handle for pulling the case on the wheels. Handles can be placed in other positions also optionally, such as on the side of the main body.

The main body 1 further comprises a frame extension body 41B attached to the bottom portion of the main body 1. The frame extension 41B is the same component as the sub-body 20B in the first embodiment, but it is attached to the main body 1 rather than being hinged to it. A panel 42 extends from the top of the frame 41B through to the interior and back panel 19 of the main body. The frame 41B, panel 19 and main body 1 form the bottom (main/primary) compartment 40B, with the panel 19 forming the divider between the bottom 40B and top 40A compartment. The main body 1 has an open side (opening) for the bottom compartment 40B. The main body 1 has an access door 24B attached to it to close off the bottom compartment 40B thus forming the bottom main compartment. The access door is the same component as the access door of the bottom sub-compartment 20B in the first embodiment. The access door 24B might be a panel, or itself also comprises sides as previously described for the first embodiment. Where the access door 24B itself comprises sides, it can also form an interior portion or compartment. The access door 24B can optionally comprise shelves or other dividers in the compartment to assist with storage and organisation of items. The access door 24B (either with or without sides) together with the frame 41B and the main body 1 forms the bottom compartment 40B when in the closed position. The access door 24B is attached to the frame extension 40B with a hinge (which could be one or more hinges such as shown in FIG. 3) along the horizontal bottom edge (when the travel cases in the portrait position). This allows the access door 24B to swing about the horizontal hinge axis (when the travel cases in the portrait position) between a closed position and an open position where the bottom compartment is accessible (along with the interior compartment of the access door if there is one). The hinge can comprise one or more hinge components (such as in FIG. 3) which may operate together or independently.

The main body 1 has an open side (opening) for the top (main/primary) compartment 40A which allows access to the interior. The top compartment can optionally comprise shelves or other dividers in the main compartment 11 to assist with storage and organisation of the items. The travel case also comprises a sub-body (which could be a frame) 20A which can be the same as in the first embodiment. The sub-body comprises a frame with sides and a backing portion 21E (as described in the first embodiment) to create a sub-compartment 22A for clothing, business tools material, other personal items or anything else typically placed in luggage. The sub-body 20A can optionally comprise shelves or other dividers 23 in the sub-compartment to assist with storage and organisation of items. The sub-body 20A has an access door 24A attached to it to close off the sub-body 20A thus forming the sub-compartment 22A. The access door can be the same as for the first embodiment. The access door might be a panel, or itself also comprise sides. Where the access door 24A itself comprises sides, it can also form an interior portion or compartment. The access door 24A can optionally comprise shelves or other dividers 27 in the compartment to assist with storage and organisation of items. The access door 24A (either with or without sides) together with the sub-body 20A forms the sub-compartment 22A when in the closed position. The access door 24A is attached to the sub-body 20A with a hinge along the horizontal bottom edge (when the travel cases in the portrait position). This allows the access door to swing along the horizontal hinge axis (when the travel cases in the portrait position) between a closed position and an open position where the sub-compartment 22A is accessible (along with the interior compartment of the access door if there is one). The hinge can comprise one or more hinge components which may operate together or independently as shown in FIG. 3.

Sub-body 20A is attached to the top portion of the main body 1 with a hinge along the vertical edge (when the travel cases in the portrait position) of the main body. This allows the sub-body to swing along the vertical hinge between a closed position in which the sub-body closes off the top main compartment 40A by blocking the opening and an open position where the opening is not blocked and the top main compartment is accessible through the opening. An aluminium rim can be placed around the perimeter of the aperture to the main compartment 40A to assist with securing and/or aligning the main body 1 with the frame/sub-body 20A, 41B when they close off the main compartment 40A. The travel case further comprises one or more locks (such as combination locks) e.g. 49 known to persons skilled in the art for securing the frame/sub-body 20A, 41B against the main compartment 40A, and/or for securing the access door(s) 24A against individual sub-compartment(s). One or more frame or bodies, for example 1, 20A, 41B further comprises sets of releasable catches (e.g. 29) to secure the frame/sub-body 20A, 41B in relation to the main compartment 40A, and/or secure the access door(s) 24A, 24B in relation to the sub-compartment(s) to retain them in the closed position. The catches could be magnetic catches or any other suitable mechanical catches.

The travel case 10 of this embodiment can be utilised in any suitable manner. For example, large and/or less needed items can be placed in the, and accessed from the, top compartment 40A by swinging the sub-body/compartment 20A/22A from the closed position to the open position. When doing so, typically the access door 24A is in the closed position, but this is not essential. Larger and less needed items can also be placed in the, and accessed from the, bottom compartment 40B by swinging the access door 24B downwards about the horizontal axis. Smaller and/or more frequently required items can be placed in the sub-compartment 22A. These can be accessed by swinging the access door 24A from the closed position to the open position to access the interior of the sub-compartment 22A. This may be done either when that sub-body 20A is in the closed position with respect to the main body 1, or when it is in the open position. The main compartment 1 can be accessed when the travel cases in any orientation, such as when flat on the surface or when in the portrait position. Preferably, it normally is accessed when in the lie flat position. Likewise, the sub-compartment 22A can be accessed when the travel case is in any orientation. Preferably, it will normally be accessed when the travel case is in the portrait position but this is not essential. It will be appreciated that when referring to the open position, it does not mean that the sub-body and/or the access doors have to be open to the full extent. Open can just mean that the door and/or sub compartments are swung open to a sufficient degree in order to access the respective compartment/sub compartment. The configuration of the travel case allows convenient organisation and access to different items for different purposes in a different manner, each manner being suitable depending on the item and situation and orientation of the travel case.

FIG. 2B shows a variation of the embodiment in FIG. 1B in more detail. FIG. 2B shows the travel case and various orientations and configurations, including the lie flat orientation, portrait orientation, and with the main compartment and/or sub-compartments open, the sub-compartment only open, and all compartments closed. The main body 1 comprises a handle 30 on the side as well is a top handle 14 and extendable handle 15. It also comprises wheels 13A, 13B (such as castors or similar) on a bottom edge. The sub-body 20A is attached to the main body 1 by a two spring hinges 31A, 31B. The spring hinge is shown in more detail FIG. 3. Any suitable number of spring hinges could be used. Wheels 13C, 13D (such as castors) are attached to the front bottom edge of the bottom main compartment 40B/frame 41B. The sub-compartment and main compartment access doors 24A, 24B also hinge on two spring hinges 32A to 32D such as shown in FIG. 3. Two stays 33A to 33D extend from the side of the respective body to the side of the access door 24A, 24B in each case to limit the extent of swing on the hinge. The stays can be any suitable mechanism, such as two-piece bi-fold stays or stays that slide within channels. In the case of the top sub-body 20A, the access door 24A can swing to 90° relative to the main body 1 in the portrait position, being held in place (open position) by and the movement being restricted by the stays 32A, 32B. This allows the interior or top surface of the access door 24A to be used as a tray and/or provides easy access to the contents of the access door 24A and the sub-compartment 22A. In the case of the bottom access door 24B, the access door can swing to 60° relative to the main body 1 in the portrait position, also being held in place by and the movement being restricted by the stays. This allows access to the interior of the bottom compartment 40B. The bottom access door 24B does not extend too far to reduce the risk of the travel case toppling over when in the portrait position through weight of items on the access door 24B. It will be appreciated that both the top and bottom access door can swing to any suitable open position angle and those angles described are not limiting.

FIG. 1C shows a third embodiment of the travel case. This embodiment is similar to the second embodiment, except that the sub-compartment is at the bottom. The travel case is a hard case and is manufactured from one or more suitable hard material(s), preferably plastics, as described above. Any aspects not fully described will be the same or similar to that described for the first and/or second embodiments.

The travel case comprises a main body 1 with at least two separate main/primary (top and bottom when in portrait position) compartments 40A, 40B for clothing, business tools or material, other personal items, or anything else typically placed in luggage. The main body 1 is of any suitable shape (typically rectangular) and can have a similar shape and exterior configurations as the first and second embodiments. A dividing portion 42 (formed in any suitable manner by any suitable structure) creates the two compartments 40A, 40B. It comprises wheels 13A, 13B rotatably attached to the bottom of the main body 1 (when viewed in the portrait position). The main body comprises one or more handles positioned at suitable locations. FIG. 1C shows two handles 14, 15—the first handle being for carrying the travel case and the second handle being an extendable handle for pulling the case on the wheels. Handles can be placed in other positions also optionally, such as on the side of the main body.

The main body 1 further comprises a frame extension body 41A attached to the top portion of the main body 1. This is the same component as the frame/sub-body 20A of the first embodiment except that is attached to the main body and not hinged from it. A panel 42 (the divider) extends from bottom of the frame through to the interior and back panel 19 of the main body 1. The frame 41A, panel 42 and main body 1 form the top (main/primary) compartment 40A, with the panel forming the dividing portion between the bottom and top compartment 40A, 40B. The main body has an open side (opening) for the top compartment 40A. The main body 1 has an access door 24A attached to it to close off the top compartment 40A thus forming the top compartment. The access door 24A might be a panel, or itself also comprises sides (as shown in FIG. 1C). Where the access door 24A itself comprises sides (such as in the first embodiment), it can also form an interior portion or compartment. The access door 24A can optionally comprise shelves or other dividers in the compartment to assist with storage and organisation of items. The access door 24A (either with or without sides) together with the main body 1 and frame 41A forms the top compartment 40A when in the closed position. The access door is attached to the frame 41A with a hinge along the horizontal bottom edge (when the travel case is in the portrait position). This allows the access door to swing about the horizontal hinge axis (when the travel cases in the portrait position) between a closed position and an open position where the top compartment 40A is accessible (along with the interior compartment of the access door if there is one). The hinge can comprise one or more hinge components (as shown in FIG. 3) which may operate together or independently.

The main body has an open side (opening) for the bottom compartment 40B which allows access to the interior. The bottom compartment can optionally comprise shelves or other dividers in the main compartment 40B to assist with storage and organisation of the items. The travel case also comprises a sub-body 20B. The sub-body comprises a frame with sides and a backing portion 21F to create a sub-compartment 22B for clothing, business tools material, other personal items or anything else typically placed in luggage. The sub-body can optionally comprise shelves or other dividers in the sub-compartment 22B to assist with storage and organisation of items. The sub-body has an access door 24B attached to it to close off the sub-body thus forming the sub-compartment. The access door 24B might be a panel, or itself also comprise sides (as shown in FIG. 1C). Where the access door itself comprises sides, it can also form an interior portion or compartment. The access door 24B can optionally comprise shelves or other dividers in the compartment to assist with storage and organisation of items. The access door (either with or without sides) together with the sub-body 20B forms the sub-compartment 22B when in the closed position. The access door 24B is attached to the sub-body 20B with a hinge along the horizontal bottom edge (when the travel cases in the portrait position). This allows the access door 24B to swing about the horizontal hinge axis (when the travel cases in the portrait position) between a closed position and an open position where the sub-compartment 22B is accessible (along with the interior compartment of the access door if there is one). The hinge can comprise one or more hinge components (as shown in FIG. 3) which may operate together or independently.

Sub-body 20B is attached to the bottom portion of the main body 1 with a hinge along the vertical edge (when the travel cases in the portrait position) of the main body. This allows the sub-body 20B to swing about the vertical hinge between a closed position in which the sub-body closes off the bottom main compartment 40B by blocking the opening and an open position where the opening is not blocked and the bottom main compartment 40B is accessible through the opening. An aluminium rim can be placed around the perimeter of the aperture to the main compartment 40B to assist with securing and/or aligning the main body 1 with the frame/sub-body 41A, 20B when they close off the main compartment 40B. The travel case further comprises one or more locks (such as combination locks) e.g. 49 known to persons skilled in the art for securing the frame/sub-body 41A, 20B against the main compartment 40B, and/or for securing the access door(s) 24A against individual sub-compartment(s). One or more frame or bodies, for example 1, 41A, 20B further comprises sets of releasable catches (e.g. 29) to secure the frame/sub-body 41A, 20B in relation to the main compartment 40B, and/or secure the access door(s) 24A, 24B in relation to the sub-compartment(s) to retain them in the closed position. The catches could be magnetic catches or any other suitable mechanical catches.

The travel case can be utilised in any suitable manner. For example, large and/or less needed items can be placed in the, and accessed from the, bottom compartment 40B by swinging the sub-body/compartment from the closed position to the open position. When doing so, typically the access door 24B is in the closed position, but this is not essential. Larger and/or less needed items can also be placed in and accessed from the top compartment 40A by swinging the access door 24A downwards along the horizontal axis. Smaller and/or more frequently required items can be placed in the sub-compartment 22B. These can be accessed by swinging the access door 24B from the closed position to the open position to access the interior of the sub-compartment 22B. This may be done either when that sub-body 20B is in the closed position with respect to the main body, or when it is in the open position. The top and bottom main compartments 40A, 40*b* can be accessed when the travel case is in any orientation, such as when flat on the surface or when in the portrait position. Preferably, it is accessed when in the portrait position. Likewise, the sub-compartment 22B can be accessed when the travel case is in any orientation. Preferably, it will normally be accessed when the travel cases in the portrait position but this is not essential. It will be appreciated that when referring to the open position, it does not mean that the sub-body and/or the access doors have to be open to the full extent. Open can just mean that the door and/or sub-compartments are swung open to a sufficient degree in order to access the respective compartment/sub compartment. The configuration of the travel case allows convenient organisation and access to different items for different purposes in a different manner, each manner suitable depending on the item and situation and orientation of the travel case.

The third embodiment can be of a form similar as that described with reference to FIG. 2B, except with the top and bottom components swapped.

FIG. 3 shows a spring hinge that can be used in any of the embodiments described. Reference to a hinge in this specification can mean broadly a hinge mechanism comprising one or more hinges, such as the spring hinge in FIG. 3. The spring hinge comprises a first baseplate 50A for attachment to the first component of the travel case being hinged. A first anchor member 51A is attached to the baseplate 50A. The spring hinge comprises a second baseplate 50B for attachment to the corresponding component of the travel case being hinged. A second anchor member 51B is attached to the baseplate 50B. A first articulated member 52 extends between a first pivot point 53 and a first pivot point 54 on the second 51B and first 51A anchor members respectively. A second articulated member 55 extends between a second pivot point 56 and a second pivot point 57 on the second 51B and the first 51A and anchor members respectively. The second articulated member 55 comprises a first extension member 58 hinged to a second extension member 59 via a pivot point 60. The first articulated member 52 comprises a rocker member 61 hinged to a third extension member 62 by a pivot point 63. The rocker member 61 has an intermediate pivot 64 that connects and hinges to member 59. The hinge can reconfigure from a compressed to an extended position whereby members 58 and 59 extend fully so that baseplates 50A and 50B sit flat on the same plane. In this position, members 61 and 62 extend over members 58 and 59. The hinge in FIG. 3 is shown in an intermediary state.

FIGS. 4 to 10 show various views of the various embodiments in more detail.

While three embodiments are described above, many other variations of main compartments and/or sub-compartments access doors could be envisaged by those skilled in the art. For example in a fourth embodiment, rather than having sub-compartments, there is a main body with two (top and bottom) compartments that are accessed by doors. This would be the equivalent of a combination of the embodiments two and three. It will also be appreciated that the term travel case can be interpreted broadly to mean any case for transportation of items, whether for business, travel, portable storage and the like.

Each embodiment can be manufactured from the same base components. The first component is the main body 1 providing an interior compartment 11. The second component is a frame/sub-body 20A, 20B (also 41A, 41B) that forms part of the sub-compartment or (main compartment in combination with the main body 1). Two frames 20A, 20B or 41A, or 41B are used in each embodiment. In the case embodiment one, the two frames 20A, 20B are hinged to the main body 1 and have back panels 21E, 21F to create sub-compartments 22A/22B the. In the case of the second and third embodiments, one of the frames is attached to the main body completely to create the top/bottom compartment, while the other frame is hinged to the main body 1 and has a backing panel 21E, 21F to create the hinging sub-compartment. The access doors 24A, 24B on each embodiment are the same. The frames 20A, 20B, 41A, 41B and doors 24A, 24B can be of the same size, or of different sizes depending on the desired size split between the top and bottom sub-compartments and/or top and bottom main compartments.

The invention claimed is:

1. A hard travel case luggage device having multiple compartments, the case comprising in combination:

the main compartment enclosed on all sides except an open side which is selectively openable to provide access into an interior of said main compartment, said main compartment enclosed by a combination of a back panel, two opposing sides extending from opposite lateral edges of said back panel, a top and a bottom, said top and said bottom extending from opposite edges of said back panel between said two opposing sides;

said open side of said main compartment bounded by a backing portion of a pair of fixed together sub-body frames, said backing portion parallel and spaced from said back panel by said interior of said main compartment when said open side of said main compartment is closed;

said pair of fixed together sub-body frames attached to one of said opposing sides of said main compartment by at least one hinge facilitating opening about a vertical axis when said bottom is oriented horizontally;

said bottom including at least two wheels thereon;

said top including at least one handle thereon;

said pair of fixed together sub-body frames having a top sub-compartment therein and a bottom sub-compartment therein;

each of said sub-compartments bounded laterally by a pair of common sub-body sides;

said pair of sub-body sides joined together at upper ends thereof by a sub-body top of said top sub-compartment;

said pair of sub-body sides joined together at lower ends thereof by a sub-body bottom of said bottom sub-compartment;

each of said sub-compartments bounded by said backing portion on an internal side of said sub-compartments adjacent to said main compartment;

said sub-body bottom of said top sub-compartment extending between said pair of sub-body sides at portions thereof between said sub-body top of said top sub-compartment and said sub-body bottom of said bottom sub-compartment;

said sub-body sides oriented in parallel vertical planes and with said sub-body bottom and said sub-body top of said top sub-compartment and said sub-body bottom of said bottom sub-compartment oriented horizontally, when said case is standing upon said bottom at least partially through said at least two wheels upon a horizontal underlying surface;

said top sub-compartment closed by a top sub-compartment access door and said bottom sub-compartment closed by a bottom sub-compartment access door, each of said access doors movable between a closed position and an open position by pivoting about hinges on lower portions of said access doors;

said top sub-compartment access door having a planar surface parallel with said backing portion when said top sub-compartment access door is in a closed position adjacent to said sub-body sides and said sub-body top of said top sub-compartment;

said top sub-compartment access door hinged at a lower portion thereof to said sub-body bottom of said top sub-compartment;

said bottom sub-compartment access door having a planar surface parallel with said backing portion when said bottom sub-compartment access door is in a closed position adjacent to said sub-body sides;

said bottom sub-compartment access door hinged at a lower portion thereof to said sub-body bottom of said bottom sub-compartment; and said top sub-compartment access door having a rim extending perpendicularly from at least upper and lateral sides of said top sub-compartment access door, with a top portion of said rim adjacent to said sub-body top of said top sub-compartment when said top sub-compartment access door is closed and with lateral side portions of said rim adjacent to said sub-body sides when said top sub-compartment access door is closed.

2. The case of claim 1 wherein said top sub-compartment access door planar surface is oriented horizontally when said top sub-compartment access door is fully open.

3. The case of claim 2 wherein said top sub-compartment access door is supported by at least one stay which is placed in tension and holds said access door horizontally when said top sub-compartment access door is fully open.

4. The case of claim 2 wherein said bottom sub-compartment access door is angled less than or equal to 30° away from vertical for said planar surface of said bottom sub-compartment access door when said bottom sub-compartment access door is open.

5. The case of claim 4 wherein said bottom sub-compartment access door is supported by at least one stay which is placed in tension and holds said bottom sub-compartment access door from opening beyond 30° when said bottom sub-compartment access door is open.

6. The case of claim 1 wherein at least one divider is located within at least one of said sub-compartments and oriented within a horizontal plane when said bottom is oriented horizontally.

7. The case of claim 1 wherein at least one releasable catch is provided adjacent to said main compartment, at least one releasable catch is located adjacent to said top sub-compartment and at least one releasable catch is located adjacent to said bottom sub-compartment.

8. The case of claim 1 wherein said at least one handle is extendable away from said top.

9. The case of claim 1 wherein said back panel, said two opposing sides, said top, said bottom, said pair of sub-body sides, said sub-body top of said top sub-compartment, said sub-body bottom of said bottom sub-compartment, said planar surface of said top sub-compartment access door and said planar surface of said bottom sub-compartment access door are each formed of a rigid planar material, whereby an outer surface of the case has a hard shell exterior.

10. The case of claim 9 wherein said hard shell exterior is formed of a material taken from the group of materials including polypropylene, polycarbonate, ABS, nylon, acrylic and polyester.

11. The case of claim 10 wherein at least one divider is located within at least one of said sub-compartments and oriented within a horizontal plane when said bottom is oriented horizontally.

12. The case of claim 11 wherein at least one releasable catch is provided adjacent to said main compartment, at least one releasable catch is located adjacent to said top sub-compartment and at least one releasable catch is located adjacent to said bottom sub-compartment.

13. The case of claim 12 wherein said at least one handle is extendable away from said top.

14. The case of claim 13 wherein said top sub-compartment access door planar surface is oriented horizontally when said top sub-compartment access door is fully open.

15. The case of claim 14 wherein said bottom sub-compartment access door is angled less than or equal to 30° away from vertical for said planar surface of said bottom sub-compartment access door when said bottom sub-compartment access door is open.

16. The case of claim 15 wherein said bottom sub-compartment access door is supported by at least once stay which is placed in tension and holds said bottom sub-compartment access door from opening beyond 30° when said bottom sub-compartment access door is open.

17. The case of claim 1 wherein said sub-body bottom of said top sub-compartment also functions as a sub-body top of said bottom sub-compartment.

18. The case of claim 1 wherein said bottom includes two wheels and two feet.

19. The case of claim 1 wherein said bottom includes four wheels rotatably supported therefrom.

20. The case of claim 1 wherein said bottom sub-compartment access door has a pair of lateral side rim portions which are adjacent to said sub-body sides when said bottom sub-compartment access door is closed;

a gap between upper ends of said pair of lateral side rim portions of said bottom sub-compartment access door; and said upper ends of said pair of lateral side rim portions of said bottom sub-compartment access door located adjacent to said sub-body bottom of said top sub-compartment.

* * * * *